United States Patent [19]

Asano et al.

[11] Patent Number: 4,961,997

[45] Date of Patent: Oct. 9, 1990

[54] THERMAL TRANSFER RECORDING MEDIUM

[75] Inventors: Masao Asano; Yumi Matsuzawa; Mutsumi Sekimoto; Kunihiro Koshizuka; Toshiaki Tezuka; Takao Abe, all of Hino, Japan

[73] Assignee: Konica Corporation, Tokyo, Japan

[21] Appl. No.: 160,174

[22] Filed: Feb. 25, 1988

[30] Foreign Application Priority Data

Mar. 2, 1987 [JP] Japan ..... 62-47254
Sep. 3, 1987 [JP] Japan ..... 62-220818

[51] Int. Cl.[5] ..... B41M 5/26

[52] U.S. Cl. ..... 428/423.1; 428/195; 428/327; 428/421; 428/422; 428/423.7; 428/447; 428/484; 428/488.4; 428/913; 428/914

[58] Field of Search ..... 428/195, 447, 484, 488.4, 428/913, 914, 327, 421, 422, 423.1, 423.7; 503/227

[56] References Cited

U.S. PATENT DOCUMENTS 4,684,561 8/1987 Imai et al. ..... 428/500
4,735,860 4/1988 Mizobuchi et al. ..... 428/423.1
4,837,198 6/1989 Kuriyama et al. ..... 503/227

FOREIGN PATENT DOCUMENTS 138483 4/1985 European Pat. Off. ..... 503/227

*Primary Examiner*—Pamela P. Schwartz
*Attorney, Agent, or Firm*—Frishauf, Holtz, Goodman & Woodward

[57] ABSTRACT

There is disclosed a thermal transfer recording medium having a thermal transfer colorant layer provided on one surface of a support and a backing layer provided on other surface of the support, characterized in that said backing layer contains a resin having a siloxane bonding in the molecular and/or a cured product of said resin and an organic powder.

6 Claims, No Drawings

THERMAL TRANSFER RECORDING MEDIUM

BACKGROUND OF THE INVENTION

This invention relates to a thermal (heat-sensitive) transfer recording medium, more specifically it relates to a thermal transfer recording medium having a backing layer.

Heretofore, at a back surface of the thermal transfer recording medium used in the thermal transfer recording system, in order to prevent a phenomenon of which a back surface of a support and a thermal head are fused at transfer (so-called sticking phenomenon) or a phenomenon of which a back surface of a support and a thermal transfer colorant layer contacted thereto, stick together when wound-up for storage (so-called blocking phenomenon), and to make smooth running property in a cassette, a backing layer has been provided at the back surface of the support.

Generally speaking, the backing layer has been formed by coating a resin component containing a powdery substance on a surface where no thermal transfer colorant layer has been provided.

As the resin component for forming such a backing layer, various resins such as an acrylic series resin, a polyester series resin and a cellulose derivative have generally been used.

On the other hand, as the powdery material, inorganic powder such as silica powder, boron nitride powder, talc and aluminum dioxide powder has generally been used.

However, according to the investigation of the present inventors', it was found that since the above inorganic powder has high hardness, a device which contacts to the backing layer, such as a thermal head is damaged, and particularly usable lifetime of the thermal head has shortened. Further, when the backing layer and the thermal transfer colorant layer has contacted for a long time, surface state of the backing layer has sometimes transferred to the thermal transfer colorant layer. In such a case, it was found that surface smoothness of the thermal transfer colorant layer has been damaged so that adhesive property between a medium to be transferred and a thermal transfer recording medium has been lowered, and thus printing quality has also been lowered.

Further, the inorganic powder is generally low in dispersibility to a resin component. If one wishes to disperse the inorganic powder in those which are widely used as a resin for the backing layer, it sometimes does not disperse therein. Such an inorganic powder which is badly dispersed falls away during running so that inner portion of the device is sometimes stained. Moreover, the inorganic powder which is badly dispersed may sometimes cause lowering printing quality by adhering to a surface of the thermal transfer colorant layer after long term contact between the backing layer and the thermal transfer colorant layer.

Also, these inorganic powders are low in dispersibility in a resin component such as a silicone series resin having good heat resistance, and it is difficult to disperse well therein by the conventional method. Accordingly, it is the present situation that in the backing layer used a resin having a good heat resistance such as a silicone series resin, it has not been investigated concretely to use and add a powdery particle.

On the other hand, in the thermal recording method used a thermal transfer recording medium, there has heretofore been involved a problem that printing quality to a transfer paper which is low in surface smoothness (so-called rough paper) is insufficient. In order to solve this problem, the method of improving printing quality to the rough paper involved an extreme increase in the printing energy used.

A thermal energy in this case is extremely high as compared with the required printing energy used with a transfer paper which is high in surface smoothness. Therefore, if a thermal transfer recording medium having a backing layer formed by the conventionally employed resin component, new problems have been caused that thermal deformation in the thermal transfer recording medium such as causing wrinkle at the printed portion due to a thermal energy at transfer is generated.

When deformed thermal transfer recording medium is wound (after use), wound diameter after use becomes larger than that before use (fatten by wind up). Accordingly, in the case that the thermal transfer recording medium used at high energy transfer is contained in a cassette and used, the thermal transfer recording medium which is a thermal tape shall be contained in the cassette by previously deducting an increase of wound diameter due to fatten by wind up after use of the thermal transfer recording medium.

In the thermal transfer recording medium used in the form of a cassette, it is advantageous that printing quantity is large per one cassette. However, by considering fatten by wind up, to remain surplus space in a cassette while maintaining a size of the conventional cassette is disadvantageous with respect to the printing quantity. But the surplus space considering fatten by wing up is provided to the conventional cassette, increase in the cassette size, and yet increase in the printer size will be caused.

SUMMARY OF THE INVENTION

The present invention has been accomplished considering the above actual conditions, and an object is to provide a thermal transfer recording medium improved in blocking resistant property and sticking resistant property.

Further, another object of the present invention is to provide a thermal transfer recording medium improved in blocking resistant property and sticking resistant property as well as showing good running property.

Moreover, a further object of the present invention is to provide a thermal transfer recording medium in which not only sticking and blocking are effectively prevented but also heat resistance is extremely good such as less damage to thermal deformation due to heat at printing and little in fattening by wind up when wound after printing.

The present invention is to accomplish the above object and the constitution thereof is a thermal transfer recording medium having a thermal transfer colorant layer provided on one surface of a support and a backing layer provided on other surface of the support, characterized in that said backing layer contains a resin having a siloxane bonding in the molecule and/or a cured product of said resin and an organic powder.

DESCRIPTION OF THE PREFERRED EMBODIMENTS

In the following, the present invention will be explained in more detail.

The thermal transfer recording medium of the present invention has a constitution of having a thermal transfer colorant layer on one surface of a support and a backing layer on another surface of the support.

Support (Substrate)

The support as the substrate to be used in the thermal transfer recording medium according to the present invention should preferably have heat-resistant strength, high dimensional stability and surface smoothness.

Examples of the material for support may include various papers such as plain paper, condenser paper, laminated paper, coated paper, etc.; sheets or films of thermoplastic resins such as polyethylene, polypropylene, polyethylene terephthalate, polystyrene, polyimide, etc.; composites of the above papers with the above thermoplastic resin films or sheets; and metal sheets such as metal foils of aluminum, etc. Any of these may suitably be used.

The thickness of the support may be generally about 60 μm or less for obtaining good thermal conductivity, particularly preferably 1.5 to 15 μm. The support may be processed in order to heighten adhesion property of the backing layer (or the thermal transfer colorant layer) a surface treatment such as corona discharge treatment, glow discharge treatment, other electrical impact treatment, flame treatment, ultraviolet ray irradiation treatment, oxidation treatment and saponification treatment, and further subbing treatment may be carried out.

Backing layer

The backing layer is provided on a surface of the above support which is not provided a thermal transfer colorant layer.

The backing layer contains, as a resin component, a resin containing a siloxane bonding or bondings in the molecule.

As examples of a silicone resin, there may be mentioned an organopolysiloxane resin represented by the following formula (I); a modified polysiloxane resin in which part of R is substituted by a substitutent having an epoxy group, an olefin group, an ether group, a hydroxyl group, a fluorine atom, an amino group or a mercapto group; and a silicone-modified resin in which part of a resin such as an urethane resin, an acrylic resin and a polyester resin is modified by the organopolysiloxane resin represented by the following formula (I) or the above modified polysiloxane resin component.

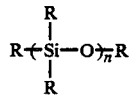

(I)

wherein in the above formula (I), R represents a lower alkyl group and n is in the range of 10 to 10,000.

Among the resins having a siloxane bonding or bondings in the molecule, a resin having a softening point (according to ASTM-D-1525) of 60° C. or higher (more preferably 80° C. or higher) is suitably used.

As the specific examples of the modified polysiloxane resin to be used in the present invention, there may be mentioned those as shown by the following formulae (1) to (6);

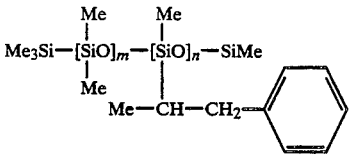

(1)

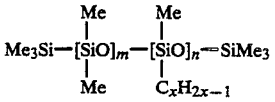

(2)

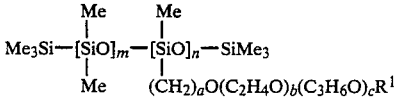

(3)

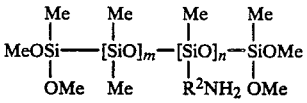

(4)

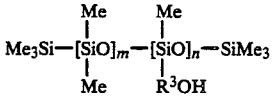

(5)

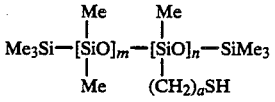

(6)

In the above formulae (1) to (6), m, n, a, b, c and x each are an integer of 0 or more, and m and n are not 0 at the same time; $R^1$ represents an alkyl group; and $R^2$ and $R^3$ each represent a divalent bonding group. Me represents a methyl group.

As the silicone-modified resin to be used in the present invention, it is preferred that a content of the organopolysiloxane resin or the modified-polysiloxane resin in the resin component is in the range of 5 to 40% by weight.

Further, among the silicone-modified resin, a silicone-modified urethane resin in which part of an urethane resin is modified with the above organopolysiloxane resin component or modified-polysiloxane resin is the most preferred one.

Among the above silicone-modified urethane resin, preferred concrete examples will be shown below:

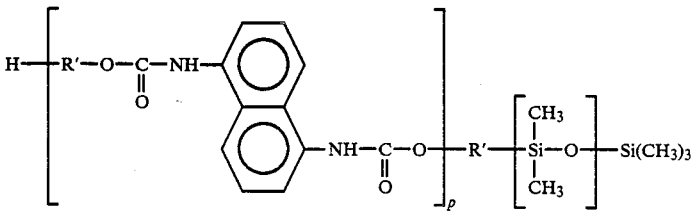

(7)

-continued (8)

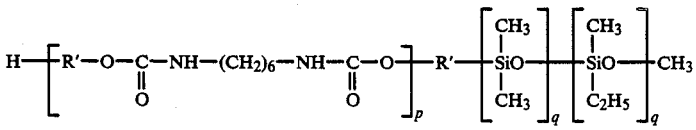

In the above formulae (7) and (8), p and q each are an integer of 0 or more and p and q are not 0 at the same time; and R' is any of the divalent bonding group represented by the formulae (9) to (12).

(9)

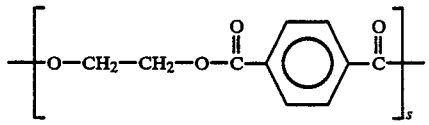

(10)

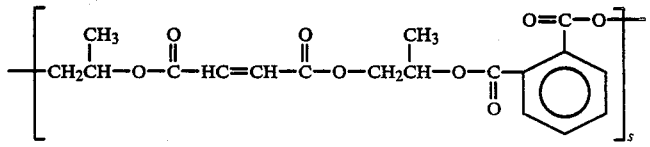

(11)

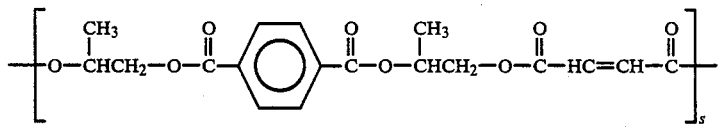

(12)

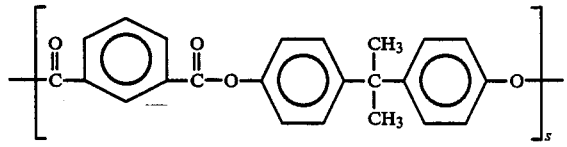

In the above formulae (9) to (12), s represents an integer.

A weight ratio of a urethane resin portion and a silicone resin portion in the above silicone-modified urethane resin is generally in the range of 99:1 to 5:95 (preferably 95:5 to 10:90).

As the resin component for constituting the backing layer, the resin having a siloxane bonding in the molecule may singly be used, but in the present invention, as a secondary resin component, it is preferred to combinedly use at least one resin selected from a polyester resin, a polyamide resin, a cellulose derivative, an acrylic resin and a polyether sulfone resin with the above resin having a siloxane bonding in the molecule. In this case, it is further preferred to combinedly use a polyisocyanate compound as a curing agent.

As the above polyester resin, the conventional thermoplastic polyester resin and a copolymer containing a polyester resin component. Particularly, in the present invention, those in which a number average molecular weight is in the range of 5,000 to 100,000 (particularly preferably 10,000 to 20,000), a softening point measured according to the same test standard as mentioned above is 70 ° C. or higher (particularly preferably 100 ° C. or higher), and a tensil break strength (ASTM D 638-61T) is 150 kg/cm$^2$ or higher are suitably used.

As the above polyamide resin, the conventional ones may be used. As the examples of the polyamide resin, there may be mentioned nylon 6, nylon 8, nylon 11, nylon 66 and nylon 610 and a copolymer containing these polyamide resin components.

Among these polyamide resin, the polyamide resin having a number average molecular weight is 10,000 or more and a softening point measured according to the same test standard as mentioned above is 70 ° C. or higher (particularly suitably 110 ° C. or higher) is suitably used.

As examples of the above cellulose derivatives, there may be mentioned cellulose esters such as acetyl cellulose, nitro cellulose and acetylbutyl cellolose; and cellulose ethers such as ethyl cellulose, methyl cellulose, benzyl cellulose and caboxymethyl cellulose.

As examples of the above acrylic resin, there may be mentioned homopolymers of methyl acrylate, ethyl acrylate, methyl methacrylate, ethyl methacrylate, acrylonitrile, acrylamide and derivatives of the above; and copolymers of the above various acryl series monomers with vinyl acetate, vinyl chloride, styrene or maleic anhydride.

Among the above various acrylic resin, those in which a number average molecular weight is 5,000 to 700,000 (particularly preferably 10,000 to 50,000) and a softening point measured according to the same test standard as mentioned above is 70 ° C. or higher (particularly preferably 90 ° C. or higher) are suitably used.

As the above polyether sulfone series resin, there may be mentioned, for example, those represented by the following formula:

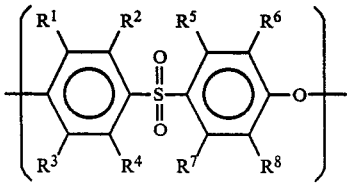

In the above formula, $R^1$ to $R^8$ each independently represent a hydrogen atom or an alkyl group having 1 to 5 carbon atoms. Particularly, in the present invention, that in which they are hydrogen atoms is preferred. Also, an average molecular weight is generally in the range of 10,000 to 500,000. The polyether sulfone series resin may by those which contain other recurring units such as bisphenol A, etc. in an amount of 50 mole % or less in addition to the recurring unit represented by the above formula.

In the present invention, it is particularly preferred to use, as a secondary resin component, the cellulose derivatives and/or the polyester series resin, and among them, cellulose esters are preferably used. When the silicone-modified urethane resin is used as the resin component having a siloxane bonding in the molecule, it is particularly preferred to combinedly use nitrocellulose. In this case, those having a nitrogen content in the range of 11.5 to 12.2% are suitably used. This is because the silicone-modified urethane resin is a resin which is relatively soft and has high elasticity modulus, and nitrocellulose is a resin having relatively high hardness so that by combinedly using the both components, the backing layer which is tough and high flexibility can be formed.

The backing layer can be formed by adding, as a binder, the above resin having a siloxane bonding in the molecule, and if necessary, the above secondary resin component. Further, the above backing layer can be made a cured material or a cross-linked material by adding aziridine, a polyisocyanate compound or a catalyst to these resins. In the present invention, it is particularly preferred to use a polyisocyanate compound.

As the polyisocyanate compound to be used in the present invention, there may be mentioned an aromatic polyisocyanate compound, an alicyclic group polyisocyanate compound and an aliphatic polyisocyanate compound.

As the polyisocyanate compound, there may be mentioned, for example, tolylene diisocyanate (TDI), 4,4'-diphenylmethane diisocyanate (MDI), xylylene diisocyanate (XDI), methaxylylene diisocyanate (MXDI) and adducts of an active hydrogen compound with the above polyisocyanate compounds. An average molecular weight in the range of 100 to 3,000 is suitable.

As the aliphatic polyisocyanate compound, there may be mentioned, for example, hexamethylene diisocyanate (HMDI), trimethylhexamethylene diisocyanate (TMDI) and adducts of an active hydrogen compound with the above polyisocyanate compounds.

Among these apliphatic polyisocyanate compound and adducts of these polyisocyanate compound and an active hydrogen compound, preferred are those having a molecular weight in the range of 100 to 3,000. Further, among the aliphatic polyisocyanate compound, non-cyclic polyisocyanate compounds and an adduct of these compounds and an active hydrogen compound are preferred.

As examples of the alicyclic polyisocyanate compound among aliphatic polyisocyanate compounds, there may be mentioned, for example, methylcyclohexane-2,4-diisocyanate

[structural formula; 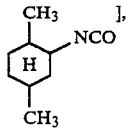 ], 4,4-methylenebis(cyclohexylisocyanate)

[structural formula; 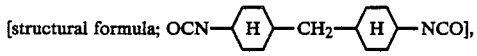 ], isophorone diisocyanate and adducts of these polyisocyanate compounds and an active hydrogen compound.

Among these aliphatic polyisocyanate compounds and adducts of these polyisocyanate compounds and an active hydrogen compound, preferred are those having a molecular weight in the range of 100 to 3,000. Further, among the aliphatic polyisocyanate compounds, a non-cyclic polyisocyanate compound and adducts of these compounds and an active hydrogen compound are preferred.

In the present invention, the polyisocyanate compound may be used singly or in combination of two or more compounds. Particularly, by combinedly using an aromatic polyisocyanate compound and other polyisocyanate compound, curing rate can be controlled.

As to an added amount of the polyisocyanate compound when it is used, it is preferably set the weight ratio of an amount of the resin having a siloxane bonding in the molecule (when the secondary resin component is further used, total weight of the the resin and the secondary resin) and that of the polyisocyanate compound in the range of 50:50 to 99:1. If the amount of polyisocyanate compound is below than the above range, curing becomes insufficient and also it exceeds the above range, running property of the thermal transfer recording medium is lowered. Further, it is particularly preferred to use the polyisocyanate compound in the above weight ratio in the range of 80:20 to 99:1.

When the aromatic polyisocyanate compound is used as a curing rate controller, mixing ratio of the aromatic polyisocyanate compound is usually set within the range of 20 to 80% by weight based on the total weight of the polyisocyanate compound to be used.

In the present invention, as the aziridine compound, generally used one can be used.

Also, in the present invention, as a curing agent, organic metals (e.g., cobalt naphthenate, tetra-n-butyl tin), inorganic metal salts (e.g., stannic chloride) or organic amines (e.g., methyl amine), etc. may be used.

Also, the resin having a siloxane bonding in the molecule can be cured by forming a cross-linking with use of a catalyst. As the catalyst to be used in the present invention, there may be mentioned, for example, a platinum catalyst, a tin catalyst and a zinc catalyst.

By addition of the catalyst, the resin having a siloxane bonding in the molecule and further the secondary resin form a cured product. In this case, a curing agent such as the polyisocyanate compound may be used or may not be used. An amount of the catalyst to be used is generally 10% by weight or less based on the resin having a siloxane bonding in the molecule.

The backing layer of the thermal transfer recording medium usually contains the resin having a siloxane bonding in the molecule and/or the cured product or cross-linked product obtained by the resin having a siloxane bonding in the molecule with the secondary resin component and the polyisocyanate compound which are used if necessary, in an amount of 20% by weight or more (more preferably 50% by weight or more, particularly preferably 80% by weight or more).

When the secondary resin component is used, the resin having a siloxane bonding in the molecule and the secondary resin are generally used, in weight ratio, in the range of 10:90 to 90:10. Preferred are in the range of 20:80 to 90:10, more preferably 50:50 to 85:15, particularly preferably 60:40 to 85:15.

In the backing layer of the thermal transfer recording medium of the present invention, an organic powder is contained.

The organic powder to be used in the present invention is generally used having an average particle size of 0.02 μm or more (preferably in the range of 0.02 to 0.5 μm). When particles containing larger maximum particle size are used, surface roughness of the backing layer becomes too high and in this case, printing quality may sometimes be lowered due to transfer to a surface of the heat softening colorant layer. Further, if the average particle size is less than 0.02 μm, the backing layer becomes too smooth whereby blocking resistant property and sticking resistant property may not necessarily be improved sufficiently.

Further, among the above organic powder, it is preferred to use those having the Mohs hardness of 7 or less. If it exceeds the above value, a device will be damaged by running. Further, when a difference to the hardness of a device such as a thermal head takes into consideration, the Mohs hardness thereof is preferably 6 or less (more preferably 5 or less). The hardness of the organic powder can be decided selectively depending upon characteristics of the material and a method for preparing the powder.

The organic powder to be used in the present invention can be roughly divided into a heat resistant organic powder and a non-heat resistant organic powder. In the present invention, from the view point of decreasing damage of the thermal transfer recording medium due to heat at printing, it is desired to use the heat resistant organic powder.

The heat resistant organic powder can further be divided into a heat resistant organic resin powder and a heat resistant organic non-resin powder.

As the heat resistant organic resin powder, there may be mentioned, for example, a benzoguanamine series resin powder, a melamine series resin powder, a polyolefin series resin powder, a polyester series resin powder, a polyimide series resin powder, a polyamide series resin powder, a polyfluorinated ethylene series resin powder, an epoxy series resin powder and a cellulose series resin powder. Also, as the heat resistant non-resin powder, there may be mentioned, for example, an organic pigment powder such as a phthalocyanine series pigment. If a dispersibility in the resin having a siloxane bonding in the molecule takes into consideration, as the organic powder, it is suitable to use the benzoguanamine series resin powder, the melamine series resin powder and the phthalocyanine series pigment powder.

Preparation methods of such organic powders have already been known and an organic powder prepared by using the conventional method can be used in the present invention.

As a starting material of the benzoguanamine series resin powder, usual benzoguanamine resin can be used, and further resins obtained by the reaction of methylol, methylene or alkylether can also be used. Also, it may be a resin in which benzoguanamine and urea, melamine or phenol, etc. are copolymerized, and in addition to the above, a resin similar to benzoguanamine, which employs as a starting material a compound represented by the following formula:

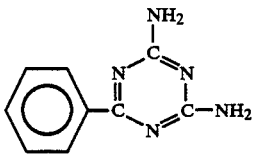

These benzoguanamine series resin can be used in the form of powder which is obtained by the conventional method such as the method in which a ball mill is used.

A shape of the benzoguanamine series resin is not particularly limited and, for example, a shape of spherical, elliptical or square may be used, but in the present invention, spherical one is preferred. This is because a surface of the backing layer formed by the spherical particles becomes to contact with points of a running system with good state whereby friction coefficient of a surface of the backing layer decreases.

In the present invention, among the benzoguanamine series resin powder, for example, since those which are porous and having a ratio of the true specific gravity/the bulk specific gravity being in the range of 1.3 to 8 show good wettability to the resin component and a solvent, they are preferred since they can be dispersed well.

As the melamine series resin powder to be used in the present invention, those in which a melamine series resin prepared by the conventional method are grinded by the same method as mentioned above may be used.

As the resin powder having a siloxane bonding in the molecule, powder of the resin having a siloxane bonding in the molecule as mentioned above may be used.

Also, as the polyfluorinated olefin series resin powder, there may be mentioned a resin obtained by polymerization of a monomer such as olefin of which at least one hydrogen atom is substituted by a fluorine atom. As such a resin, there may be mentioned, for example, a tetrafluoroethylene resin, a tetrafluoroethylene-hexafluoropropylene copolymer resin, a tetrafluoroethylene-perfluoroalkoxyethylene copolymer resin, a trifluorochloroethylene resin, a tetrafluoroethylene-ethylene copolymer resin, a vinylidene fluoride resin and a vinyl fluoride resin. These fluorine resin may be used singly or in combination of two or more kinds.

Further, as the polyolefin series resin powder, the polyester series resin powder, the polyimide series resin powder and the polyamide series resin powder, conventionally used ones can be used.

The phthalocyanine series pigment which is a heat resistant non-resin powder and used as the organic powder in the present invention is usually represented by the formula: $(C_8H_4N_2)R_n$. As R, there may be mentioned atoms such as H, Na, K, Cu, Ag, Be, Mg, Ca, Zn, Cd, Ba, Hg, Al, Ga, Ir, La, Nd, Sm, Eu, Gd, Dy, Ho, Er, Th, Tm, Yb, Lu, Ti, Sn, Hf, Pb, V, Sb, Cr, Mo, U, Mn, Fe, Co, Ni, Rh, Pd, Os and Pt. n is 0 to 2. As the phthalocyanine series pigments, there have been known crystalline forms such as $\alpha$, $\beta$, $\gamma$, $\pi$, $\chi$ and $\epsilon$, and in the present invention, any types of the crystalline forms may be used. In the above general formula, for example, a phthalocyanine series pigment substituted by a halogen atom such as a chlorine atom may be used.

In the present invention, among the above heat resistant resin powder and the heat resistant non-resin powder, when considering dispersibility to the resin having a siloxane bonding in the molecule which is a binder of the backing layer, the resin powder having a siloxane bonding in the molecule, the polyfluorinated olefin series resin powder, the benzoguanamine series resin powder and the melamine series resin powder are preferred among the heat resistant resin powder, and among the heat resistant non-resin powder, the phthalocyanine series pigment is preferred.

These heat resistant resin powder and the heat resistant non-resin powder have substantially the same effect with respect to characteristics such as blocking resistance and sticking resistance, respectively. However, since the backing layer has run contacting with a running system of a device (for example, a thermal head, a supporting pole) at printing, in order to provide good running property to the thermal transfer recording medium, a friction coefficient of the backing layer is desirably within a constant range. Therefore, among the heat resistant resin powder and the heat resistant non-resin powder to be used in the present invention, it is preferred to use a powder having a sliding property (sliding powder). As the sliding powder, there may be mentioned the resin powder having a siloxane bonding in the molecule as mentioned above and the fluorinated olefin series resin powder.

That is, a friction coefficient ($\mu$ value) of a surface of the backing layer using the resin having a siloxane bonding in the molecule as the binder resin, and adding the aforesaid said organic powder generally becomes 0.3 or less. And by using the resin powder having a siloxane bonding and/or polyfluorinated olefin series resin powder as the organic powder, the function coefficient ($\mu$ value) of a surface of the backing layer can be made 0.15 or less. Further, if the resin powder having a siloxane bonding and the polyfluorinated olefin series resin powder are compared with each other as the organic powder, the case where the polyfluorinated olefin series resin powder is used tends to show a lower friction coefficient.

In the present invention, while the resin having a siloxane bonding in the molecule is used as a binder resin for forming the backing layer, contact of the backing layer of the thermal transfer recording medium of the present invention containing the organic powder and a running system, etc. is basically contact with points, to the contrary, contact of the backing layer containing no organic powder and a running system, etc. is contact with faces. Accordingly, even when a resin for forming the backing layer and a resin which forms powder comprise the same resin component, from the difference of existing forms of both resins in the backing layer, effects of both resins exerted to various characteristics such as blocking resistance, sticking resistance, running properties and heat resistance, etc, are quite different from each other.

A shape of the organic powder to be used in the present invention is not particularly limited and, for example, a shape of spherical, elliptical or square may be used, but in the present invention, spherical or elliptical one is preferred. This is because a surface of the backing layer formed by the spherical or elliptical particles becomes to contact with points of a running system with good state whereby friction coefficient of a surface of the backing layer decreases.

A weight ratio of the resin having a siloxane bonding in the molecule and the above organic powder is preferably set within the range of 75:25 to 99.9:0.1. Further, a content of the organic powder in the backing layer is usually 8% by weight or less (preferably 5% by weight or less, more preferably 0.1 to 3% by weight). If the amount of the organic powder is too much, dispersion state is sometimes lowered.

Also, when the heat resistant resin powder is used, a content of the heat resistant resin powder is preferably set, in general, in the range of 1 to 30% by weight. Further, a ratio of the resin having a siloxane bonding in the molecule and the heat resistant resin powder is preferably set within the range of 50:50 to 99:1.

In the backing layer, in addition to the above components, additives such as waxes, surfactants, higher aliphatic acid derivatives, higher aliphatic alcohols, higher aliphatic ethers and phosphates may be added. A formulated amount of these components is preferably, in general, in the range of 1 to 20% by weight (preferably 1 to 9% by weight) in total based on the total amount of the component constituting the backing layer.

A thickness of the backing layer is generally 0.01 $\mu$m or more, and practically, it is more preferred in the range of 0.03 to 1.0 $\mu$m. Further, in general, the thickness should be made thicker than an average particle size of the organic powder to be used. The thickness shall be generally twice or more (preferably three times or more) to the average particle size to be used so as to incorporate the organic powder in the backing layer effectively. If the thickness is thinner than twice, the organic powder will likely be released therefrom during running, or released and transfer to the thermal transfer colorant layer during preservation whereby printing quality will be lowered.

As a method for providing a backing layer, for example, the method in which a coating solution prepared by dispersing the above backing layer composition in a solvent is to carry out solvent coating may suitably be utilized. As solvents herein used, any solvent may be used so long as it can dissolve or disperse each component to form a coating solution and there may be mentioned, for example, organic type solvents of paraffin type solvents such as n-hexane, ligroin, isoparafin, etc.; aromatic type solvents such as toluene, xylene, etc.; ketone type solvents such as acetone, methyl ethyl ketone, methyl isobutyl ketone, etc.; alcohol type solvents such as methanol, ethanol, propanol, butanol, etc.; ester type solvents such as ethyl acetate, etc.; specific solvent such as dimethylformamide, dimethylsulfoxide, etc., and mixtures of the above solvents.

For coating, optional coating technique such as the reverse roll coater method, the extrusion coater method, the gravure coater method or the wire bar coating method may be employed.

When the polyisocyanate compound is used, it is preferred to provide a curing procedure such as a heating procedure to accelerate the curing reaction.

The organic powder is different from an inorganic particle which is generally used as a filler for a backing layer and it shows good dispersibility to the resin component having a siloxane bonding in the molecule. Accordingly, when preparing the backing layer of the thermal transfer recording medium according to the present invention, since the organic powder can be easily dispersed in a coating solution, the organic power is in good dispersion state in the backing layer.

Further, by employing the polyisocyanate compound, the backing layer becomes a resin cured material so that the backing layer has better heat resistance and durability. Also, by combinedly using the resin having a siloxane bonding in the molecule and the secondary resin component, and further by using the polyisocyanate compound, the backing layer has good durability as well as its friction coefficient becomes low.

The backing layer thus provided is roughed the surface with the state corresponding to the organic powder. Accordingly, the backing layer contacts with points to the thermal transfer colorant layer at the state of winding up, and during running, it contacts with points to a thermal head.

Thermal transfer colorant layer

A thermal transfer colorant layer usually comprises dispersing a colorant such as carbon black in a heat-fusible substance such as waxes and/or a thermoplastic resin such as a polyethylene-vinyl acetate copolymer, etc.

A thickness of the thermal transfer colorant layer is usually 15 μm or less (preferably in the range of 1 to 6 μm).

The thermal transfer colorant layer of the thermal transfer recording medium of the present invention may contain substances which are generally used in this layer conventionally.

Other matter of the thermal transfer recording medium

As to a shape of the thermal transfer recording medium, it is not particularly limited, and it may be shaped such as a tape, etc. in accordance with a demand.

Further, the thermal transfer recording medium of the present invention may be used in the same manner as in the conventional one.

For example, the thermal transfer recording medium in the state of a tape is contained in a cassette in the state of winding up and used.

In the thermal transfer recording medium of the present invention present invention, since the backing layer contains a resin having a siloxane bonding in the molecule and an organic powder, a surface of the backing layer is roughed so that the thermal transfer colorant layer and the backing layer become to contact with points. Further, since the resin component do not show adhesive property, blocking generating temperature becomes high whereby blocking property has been improved. Moreover, contact with a thermal head is also contact with points, and since heat resistance of the resin is also good, sticking property has been improved.

Also, since a surface of the backing layer is suitably rough surfaced and a resin which forms the layer contains a siloxane bonding, a friction coefficient (μ value) on a surface of the backing layer becomes low so that the thermal transfer recording medium becomes to have good running property. Particularly, the backing layer obtained by combinedly using a silicone-modified polyurethane resin and nitrocellulose and cured these components with a polyisocyanate compound has good durability and heat resistance. In addition, by roughing its surface with characteristics of the resin components and the organic powder, the friction coefficient of the backing layer becomes extremely low whereby particularly excellent running property can be obtained.

According to the above, since the thermal transfer recording medium of the present invention has a good dispersion state, no release of the powder particles or no adhesion to a surface of the thermal transfer colorant layer is caused during running or preservation. Further, since the particles used are organic powder and have low hardness, unevenness on a surface of the backing layer is not transferred to a surface of the thermal transfer colorant layer so that no lowering of printing quality is caused.

Further, in the thermal transfer recording medium of the present invention, since the backing layer which directly contact with a thermal head contains a resin having a siloxane bonding in the molecule and an organic powder, even when a printing energy is heightened in order to improve printing quality to a rough paper, damage of the thermal transfer recording medium becomes extremely little due to action of the above resin and the powder. Accordingly, difference between a winding up diameter of the thermal transfer recording medium before printing and that after printing becomes extremely small and fatten by wind up becomes little, whereby it is not necessary to provide a surplus space in a cassette and the space in the cassette can be effectively utilized.

EXAMPLES

In the following, Examples of the present invention will be mentioned but the present invention is not limited by these at all. In the following description, all "parts" means "parts by weight".

Example 1

On a polyethyleneterephthalate film as a support having a thicknes of 3.5 μm, a coating solution of which 2 parts by weight of a backing layer coating composition (I) having the following composition was dissolved in 98 parts by weight of an organic solvent (toluene/methyl ethyl ketone (weight ratio)=1/1) was coated by using a wire bar with a thickness of 0.3 μm, and then it was cured at 50 ° C. for 60 hours to form a backing layer.

| Backing layer coating composition (I) (in terms of solid weight) | |
|---|---|
| Silicone-modified polyurethane resin (number average molecular weight: about 20,000, silicone component content: 21% by weight) | 20 parts |
| Nitrocellulose (½ material) | 80 parts |
| Polyisocyanate compound (trade name: Desmodule L, available from Nippon Polyurethane Co.) | 15 parts |
| Benzoguanamine resin powder (average particle size: 0.3 μm, Mohs hardness: 4, true specific gravity: 1.35, true specific gravity/bulk specific gravity: 3.38) | 2 parts |

Then, on other surface of the support of which the above backing layer was not provided, a thermal softening layer coating composition having the following composition was coated by using a wire bar with a thickness of 2.0 μm to form a thermal softening layer to obtain a thermal transfer recording medium.

| Thermal softeninq layer coating composition | |
|---|---|
| Acrylic resin | 50 parts |

-continued

| Thermal softeninq layer coating composition | |
|---|---|
| Paraffin wax [melting point: 70° C.] | 25 parts |
| Carnauba wax | 10 parts |
| Carbon black | 25 parts |

Comparative example 1

A thermal transfer recording medium was prepared in the same manner as in Example 1 except that in place of the silicone-modified polyurethane resin, the same amount of nitrocellulose was added.

Comparative example 2

A thermal transfer recording medium was prepared in the same manner as in Example 1 except for using alumina powder (average particle size: 0.2 μm, Mohs hardness: 9) in place of the benzoguanamine resin powder. Incidentally, when preparing a backing layer coating composition, alumina powder was hardly mixed and it took ten times of time for mixing as compared with a mixing time in Example 1.

Example 2

A thermal transfer recording medium was prepared in the same manner as in Example 1 except for using a phthalocyanine pigment (average particle size: 0.3 μm, Mohs hardness: 5) in place of the benzoguanamine resin powder.

Evaluation

Blocking resistance 90 m of the resulting thermal transfer recording medium was contained in a cassette, and blocking generating temperature was measured at 80 g/cm$^2$ load by the temperature gradiation method.

Sticking resistance 100 reels of the thermal transfer recording medium obtained were recorded (printed) at a printing rate of 40 cps by using a thermal printer (24 dots serial head, platen pressure: 250 g/head, platen rubber hardness: 70° ) and generation of sticking was evaluated.

In Table 1, those which are good in sticking resistance are shown with O, and those observed sticking are shown with X.

Also, after running, the running system was observed with eyes whether defect was exist or not.

Running property 100 reels of the thermal transfer recording medium which were the same as used in the evaluation of the above blocking resistance test were provided, and run by using the above thermal printer.

In Table 1, those which do not change in running rate are shown with O, and those which changed in running rate are shown with X.

Friction coefficient

A friction coefficient of a surface of the backing layer of the thermal transfer recording medium obtained was measured.

The measured results are shown in Table 1.

TABLE 1

| | Example | | Comparative example | |
|---|---|---|---|---|
| | 1 | 2 | 1 | 2 |
| Blocking resistance (°C.) | 62 | 60 | 45 | 48 |

TABLE 1-continued

| | Example | | Comparative example | |
|---|---|---|---|---|
| | 1 | 2 | 1 | 2 |
| Sticking resistance | | | X | X |
| Existance of defect | None | None | " | " |
| Running property | | | X | X |
| Friction coefficient (μvalue) | 0.18 | 0.17 | 0.25 | 0.23 |

Example 3

A thermal transfer recording medium was prepared in the same manner as in Example 1 except that by using a backing layer coating composition (II) as shown below, a coating solution was prepared and the coating solution obtained was coated with a thickness of 0.3 μm, and then heated at 120° C. for 1 minute to prepare a backing layer.

| Backing layer coating composition (II) | |
|---|---|
| Silicone resin (SP-212V, trade name, available from Dainichi Seika K.K.) | 80 parts |
| Fluorine resin powder (average particle size: 0.2 μm, trade name: Rublon, available from Daikin K.K.) | 20 parts |

Comparative Example 3

A thermal transfer recording medium was prepared in the same manner as in Example 3 except for using a backing layer coating composition (II-C) as shown below to form a backing layer.

| Backing layer coating composition (II - C) | |
|---|---|
| Silicone resin (SP-212V, available from Dainichi Seika K.K.) | 100 parts |

Example 4

A thermal transfer recording medium was prepared in the same manner as in Example 1 except for using a backing layer coating composition (III) as shown below.

| Backing layer coating composition (III) | |
|---|---|
| Silicone resin (SD-7226, trade name, available from Toray Silicone Co.) | 70 parts |
| Fluorine resin powder (average particle size: 0.2 μm, trade name: Rublon, available from Daikin K.K.) | 20 parts |
| Platinum catalyst (platinum content: 5% by weight) | 10 parts |

Example 5

A thermal transfer recording medium was prepared in the same manner as in Example 1 except for using a backing layer coating composition (IV) as shown below.

| Backing layer coating composition (IV) | |
|---|---|
| Silicone resin (SP-203V, trade name, available from Dainichi Seika K.K.) | 70 parts |
| Fluorine resin powder (average particle size: 0.2 μm, trade name: Rublon, available from Daikin K.K.) | 20 parts |
| Polyester resin (Byron 200, trade name, available from Toyobo K.K.) | 10 parts |

Comparative example 4

A thermal transfer recording medium was prepared in the same manner as in Example 5 except for using a backing layer coating composition (IV-C) as shown below.

| Backing layer coating composition (IV - C) | |
|---|---|
| Silicone resin (SP-203V, trade name, available from Dainichi Seika K.K.) | 70 parts |
| Polyester resin (Byron 200, trade name, available from Toyobo K.K.) | 30 parts |

Example 6

A thermal transfer recording medium was prepared in the same manner as in Example 1 except for using a backing layer coating composition (V) as shown below.

| Backing layer coating composition (V) | |
|---|---|
| Silicone resin (SP-2105, trade name, available from Dainichi Seika K.K.) | 40 parts |
| Fluorine resin powder (average particle size: 0.2 μm, trade name: Rublon, available from Daikin K.K.) | 15 parts |
| Nitrocellulose (Celnova, trade name, available from Asahi Kasei K.K.) | 40 parts |
| Polyisocyanate compound (D-70, trade name, available from Dainichi Seika K.K.) | 5 parts |

Comparative example 5

A thermal transfer recording medium was prepared in the same manner as in Example 5 except for using a backing layer coating composition (V-1C) as shown below.

| Backing layer coating composition (V - 1C) | |
|---|---|
| Silicone resin (SP-2105, trade name, available from Dainichi Seika K.K.) | 40 parts |
| Nitrocellulose (Celnova, trade name, available from Asahi Kasei K.K.) | 55 parts |
| Polyisocyanate compound (D-70, trade name, available from Dainichi Seika K.K.) | 5 parts |

Comparative example 6

A thermal transfer recording medium was prepared in the same manner as in Example 5 except for using a backing layer coating composition (V-2C) as shown below.

| Backing layer coatinq composition (V - 2C) | |
|---|---|
| Fluorine resin powder (average particle size: 0.2 μm, trade name: Rublon, available from Daikin K.K.) | 15 parts |
| Nitrocellulose (Celnova, trade name, available from Asahi Kasei K.K.) | 80 parts |
| Polyisocyanate compound (D-70, trade name, available from Dainichi Seika K.K.) | 5 parts |

Evaluation

The resulting thermal transfer recording medium was contained in a cassette so winding to a core as to become a wind up diameter of 38 mm.

Preventive effect of thermal damage of the thermal transfer recording medium Evaluation of fatten by wind up The thermal transfer recording medium obtained were set to a thermal printer (trial device No. 2, available from Konishiroku Photo Industry Co., Ltd.) (24 dots serial head, platen pressure: 200 g/head, applied energy: 38 mJ/head, platen rubber hardness: 30°) of a word processor and solid printing was carried out to a spica bond paper having a smoothness of 10 seconds with a printing rate of 20 cps, and then wound up with a 50 g/cm torque.

After the thermal transfer recording medium in the cassette had spent, a diameter of the wound up thermal transfer recording medium used was measured by dismantling the cassette.

The results are shown in Table 2.

In Table 2, symbols mean as follows:

| Diameter of the wound up thermal transfer recording medium | |
|---|---|
| Symbol | (Wound up diameter) |
| ◎ | not more than 40 mm |
| ○ | in the range of 40 mm or more and not more than 42 mm |
| Δ | in the range of 42 mm or more and not more than 44 mm |
| X | 44 mm or more |

Deterioration in density

By using the thermal transfer recording medium obtained, printing was carried out by using the above device. Separately, a thermal transfer recording medium which was obtained by the same conditions was stored at a temperature of 55 ° C. for 24 hours was printed with the same condition and both of the printing quality were compared with each other.

The results are shown in Table 2.

In Table 2, symbols mean as follows:

| Symbol | Difference between printing quality |
|---|---|
| ◎ | There is no difference in density in both |
| ○ | medium and reproduces 1 dot well. There is some defect in dot in the thermal |

-continued

| Symbol | Difference between printing quality |
|---|---|
| | transfer recording medium after preservation but printing quality is substantially good |
| Δ | There is some defect in dot in the thermal transfer recording medium after preservation and printing quality is bad. |
| X | There is defect in dot and blur is generated in the thermal transfer recording medium after preservation and remarkable deterioration in printing quality is observed. |

Running property 90 m of the thermal transfer recording medium obtained was contained in a cassette and 100 reels of this cassette have run by using the above thermal printer. Change in the running rate was observed with eyes.

| Symbol | Difference between printing quality |
|---|---|
| ◎ | No change in the running rate is observed. |
| ○ | A little change in the running rate is observed |
| Δ | While change in the running rate is observed, lowering in printing quality is not observed. |
| X | The running rate changes and according to the change thereof, printing quality also changes. |

Sticking resistance

The thermal transfer recording medium obtained was recorded (printed) with the same printing conditions as in the above evaluation concerning fatten by wind up, and generation of sticking was evaluated.

The results are shown in Table 2.

In Table 2, symbols mean as follows:

| Symbol | State of sticking generation |
|---|---|
| ◎ | No sticking is observed. |
| ○ | The thermal transfer recording medium sometimes slightly adhere to a thermal head, but there is no effect to printing quality and running property. |
| Δ | The thermal transfer recording medium often adhere to a thermal head and lowering in running property is observed. |
| X | The thermal transfer recording medium frequently adhere to a thermal head and lowering in running property as well as lowering in printing quality are observed. |

Friction coefficient (μ value)

A friction coefficient of a surface of the backing layer of the thermal transfer recording medium obtained was measured.

The measured results are shown in Table 2.

TABLE 2

| | Fatten by wind up | Lowering in density | Running property | Sticking resistance | Friction coefficient |
|---|---|---|---|---|---|
| Example 3 | ◎ | ◎ | ○ | ◎ | 0.12 |
| Comparative example 3 | Δ | ○ | ○ | Δ ◎ | 0.18 |
| Example 4 | ◎ | ○ | ◎ | ◎ | 0.10 |
| Example 5 | ◎ | ◎ | ◎ | | 0.11 |
| Comparative example 4 | X | ○ | X ◎ | ○ | 0.17 |
| Example 6 | ◎ | ◎ | | ◎ | 0.12 |
| Comparative example 5 | Δ | ○ | Δ | ◎ | 0.17 |
| Comparative example 6 | Δ | ○ | X | X | 0.20 |

We claim:

1. A thermal transfer recording medium having a thermal transfer colorant layer provided on one surface of a support and a backing layer provided on other surface of the support, wherein the improvement comprises said backing layer containing a cured product of a mixture of a silicone-modified polyurethane resin and a heat-resistant organic powder.

2. The thermal transfer recording medium according to claim 1, wherein the content of said organic powder in the backing layer is in the range of 0.1 to 50% by weight based on total weight of said layer.

3. The thermal transfer recording medium according to claim 2, wherein said organic powder is a fluorine plastic powder.

4. The thermal transfer recording medium according to claim 1, wherein the content of said resin having a siloxane bonding in the molecule in the backing layer is 20% by weight or more based on the total weight of the backing layer.

5. The thermal transfer recording medium according to claim 1, wherein said heat resistant organic powder has lubricity.

6. The thermal transfer recording medium according to claim 1, wherein said organic powder is a fluorine plastic powder.

* * * * *